US006953277B2

(12) United States Patent
Karslake et al.

(10) Patent No.: US 6,953,277 B2
(45) Date of Patent: Oct. 11, 2005

(54) FLOWABLE MATERIAL MIXING BAG

(75) Inventors: Paul Howard Karslake, Leigh on Sea (GB); Michael John Clark, Southend on Sea (GB)

(73) Assignee: Banana Bag Limited, Rayleigh (GB)

( * ) Notice: Subject to any disclaimer, the term of this patent is extended or adjusted under 35 U.S.C. 154(b) by 131 days.

(21) Appl. No.: 10/380,097

(22) PCT Filed: Sep. 3, 2001

(86) PCT No.: PCT/GB01/03938

§ 371 (c)(1),
(2), (4) Date: Mar. 7, 2003

(87) PCT Pub. No.: WO02/20146

PCT Pub. Date: Mar. 14, 2002

(65) Prior Publication Data

US 2004/0095843 A1 May 20, 2004

(51) Int. Cl.[7] ..... B65D 33/06; B65D 33/24
(52) U.S. Cl. ..... 366/130; 206/219; 383/10
(58) Field of Search ..... 366/129–130; 206/219, 221, 568; 383/4, 6–10, 21, 63, 66, 907

(56) References Cited

U.S. PATENT DOCUMENTS 2,107,851 A * 2/1938 Boehm
3,419,258 A * 12/1968 Ritchie
3,860,219 A * 1/1975 Nickerson, Jr.
3,986,661 A * 10/1976 Johnson
4,540,089 A * 9/1985 Maloney
5,052,554 A * 10/1991 Leonard
5,465,833 A * 11/1995 Tarter
5,618,105 A * 4/1997 Baker
5,664,296 A * 9/1997 May
5,709,467 A * 1/1998 Galliano, II
5,743,636 A 4/1998 Payne
6,120,817 A * 9/2000 Archibald et al.
6,132,780 A * 10/2000 Archibald et al.
6,149,555 A * 11/2000 Kinback
6,298,984 B1 * 10/2001 Weaver et al.
6,398,401 B1 * 6/2002 Arceneaux
6,523,989 B2 * 2/2003 Carty

FOREIGN PATENT DOCUMENTS

| | | |
|---|---|---|
| FR | 2 765 195 | 12/1998 |
| GB | 2227928 | 8/1990 |
| WO | 01 08860 | 2/2001 |

OTHER PUBLICATIONS

British Search Report dated Jan. 4, 2001 for British Patent Application No. GB 0021924.6.

* cited by examiner

*Primary Examiner*—Charles E. Cooley
(74) *Attorney, Agent, or Firm*—Alec Messulam; Jon A. Gibbons; Fleit, Kain, Gibbons, Gutman, Bongini & Bianco P.L.

(57) ABSTRACT

Flowable materials, such as cement and sand, are mixed by placing the materials to be mixed in an elongate flexible resealable bag having handles at its opposite ends and alternately raising and lowering the handles relative to one another to cause the materials to tumble alternately in opposite directions within the bag. The bag is fashioned to have a greater girth at its center than near its ends.

12 Claims, 3 Drawing Sheets

FLOWABLE MATERIAL MIXING BAG

CROSS REFERENCE TO RELATED APPLICATIONS

This application is based upon and claims priority from prior PCT Application No. PCT/GB0102938 which claims filed on Sep. 3, 2001, which claims priority from prior Great Britain Application No. 0021924.6, filed Sep. 7, 2000, each of these prior disclosures are hereby incorporated by reference hereinto in their entirety.

FIELD OF THE INVENTION

The present invention relates to a bag for mixing a powder or other flowable solid either with another flowable solid or with a liquid.

BACKGROUND OF THE INVENTION

There are many applications in which it is required to mix two powders or to prepare a mix of a powder and a liquid. In particular in the building trade, one may need to mix flowable solids such as sand, cement and ballast and to add water to form wet concrete.

Hitherto, the conventional method used for mixing powders with one another and with liquids has been to churn the ingredients. Cement mixers used for preparing plaster, mortar, cement and concrete use a drum that constantly rotates in the same direction and has an internal screw for turning the constituents over or churning them until they are thoroughly mixed.

DESCRIPTION OF RELATED ART

There are several disadvantages to mixing ingredients in this manner. The first is that the process is somewhat messy and the ingredients are often spilled. Second, the container used for the mixing is difficult to clean. When preparing building materials, contamination between batches can cause some materials, such as plaster, to become unworkable very quickly. Furthermore, cement mixers require power and cannot be used in locations where electricity is not readily available.

In U.S. Pat. No. 5,743,636, it is proposed to mix single bag quantities of blended cement and aggregate with water to form concrete using a flexible mat that is arranged with a shallow central basin bounded by a flat skirt. A plurality of handles, suitably four, are provided in the skirt near the mat edge. A sufficient amount of water to mix with a single bag or batch of pre-blended cement and aggregate is placed in the basin, and the batch amount of cement and aggregate is then poured onto the mat atop the water. Two persons grasp the mat by way of adjacent handles and mix the water with the cement and aggregate by alternately raising and lowering diagonally opposite mat handles.

Though this proposal avoids the need for power, it is still very messy, especially when used with fine powders such as plaster, because the powder is not contained during the mixing process nor while it is being poured from a bag into the basin of the mixing mat.

FR 2 765 195 discloses packaging for two constituents that are to be mixed with one another. To mix the constituents, they are placed in a cylindrical flexible tube and the ends of the tube are raised and lowered alternately to cause the contents to tumble and mix with one another.

In practice, it is found that when using a cylindrical tube, there is a tendency for the bag to form a deep crease at the lowest point of the bag and instead of bringing about the desired tumbling motion of the contents, raising and lowering the ends of the bag only serves to move the crease along the bag.

SUMMARY OF THE INVENTION

The present invention overcomes the problems with the prior art and provides a bag for mixing flowable materials which mitigates the foregoing problem and enables mixing of flowable solids to be carried out manually and easily under clean conditions.

According to a first aspect of the present invention, there is provided a bag for enabling a flowable solid to be mixed with a liquid, the bag being elongate and having walls formed entirely of a flexible liquid impermeable material, the bag further having a handle at each end and a resealable mouth for enabling the ingredients to be mixed to be introduced into the bag, characterised in that the bag is fashioned to have a greater girth at its center than near its ends.

According to a second aspect of the invention, there is provided a package comprising one or more flowable solids contained within an elongate flexible liquid-impermeable bag having a handle at each end for enabling the bag to be gripped manually and a resealable mouth for allowing a liquid to be added to the contents of the bag, characterised in that the bag is fashioned to have a greater girth at its center than near its ends.

The bag may suitably be formed by welding two sheets of plastics material to one another along a curved a path.

The seal used to close the bag need only be sufficient to prevent powder ingredients from escaping and may be formed in the same way as the extruded seals on some polythene bags which comprise a cylindrical bead on one side received in a cylindrical socket on the opposite side.

It is desirable for the bags used for mixing to be disposable bags so that they may also serve for packaging the constituents of the mixture. In this case, there is no need to clean the bags after use and there is no risk of cross contamination between batches of the mixture.

BRIEF DESCRIPTION OF THE DRAWINGS

The subject matter which is regarded as the invention is particularly pointed out and distinctly claimed in the claims at the conclusion of the specification. The foregoing and other features, and advantages of the invention will be apparent from the following detailed description taken in conjunction with the accompanying drawings, in which:

DETAILED DESCRIPTION OF THE PREFERRED EMBODIMENTS

Figure 1:
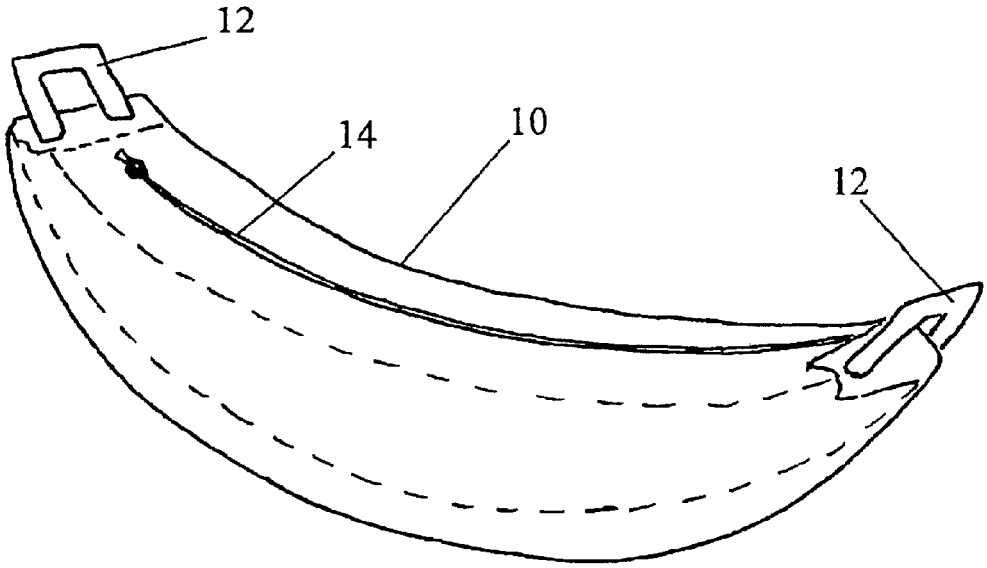
FIG. 1 is a perspective view of a mixing bag.

It should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality. In the drawing like numerals refer to like parts through several views.

FIG. 1 shows a banana-shaped mixing bag 10 with handles 12 at its opposite ends and a fastener 14 extending along its length. The bag 10 is made of a plastics material, such as polyethylene, which is liquid-impermeable and strong enough to support the weight of the mix which is to prepared within it. The fastener 14 is preferably of the extruded type used in resealable bags, having a part cylindrical bead along one side and an elongate part cylindrical socket for receiving the bead along the opposite side. It is alternatively possible to form the fastener as a zip fastener. The mouth of the bag may take other forms so long as it may be resealed after it has been opened. The "seal" in this context need not necessary be an airtight seal, so long as it is able to prevent the powder from escaping from the bag during mixing.

Figure 2:
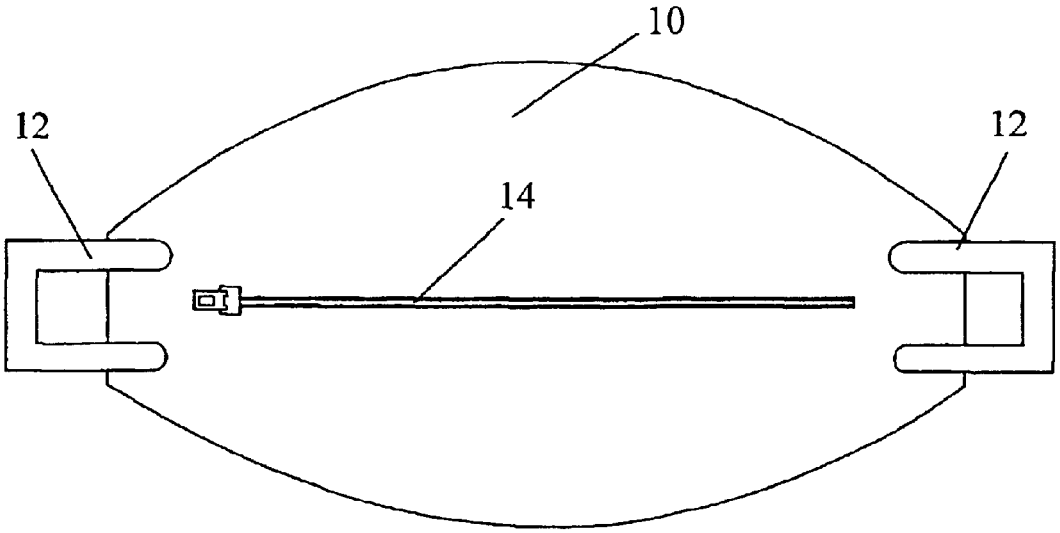
FIG. 2 is a plan view of the mixing gab shown in FIG. 1 when empty.

The bag of FIG. 1 is shown in FIG. 2 in its flat state, before being filled with the constituents of the mix. The bag 10 can be formed by welding two sheets of plastics material along a generally elliptical path. The handles 12 are formed separately and attached to the plastics material of the bag. In the alternative construction shown in FIG. 3, the handles 12' are formed by cut-outs with welded edges. FIGS. 1 and 2 illustrate two handles 12 lying in a plane. An elongated body of the bag 10 in FIGS. 1, 2, and 3, illustrates in an embodiment that body is formed to have a greater width in the plane at a center portion of the elongated body that tapers to a smaller width near the first end and the second end.

Figure 3:
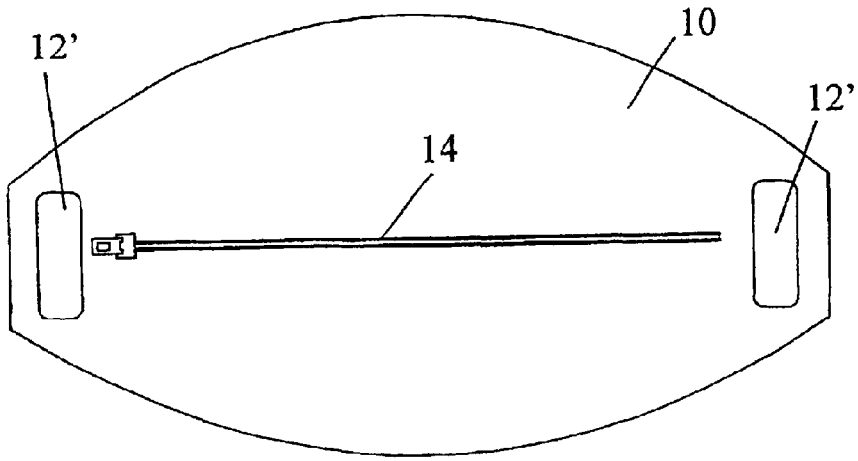
FIG. 3 is a view similar to that of FIG. 2 showing a mixing bag with an alternative form of handle.
Figure 4:
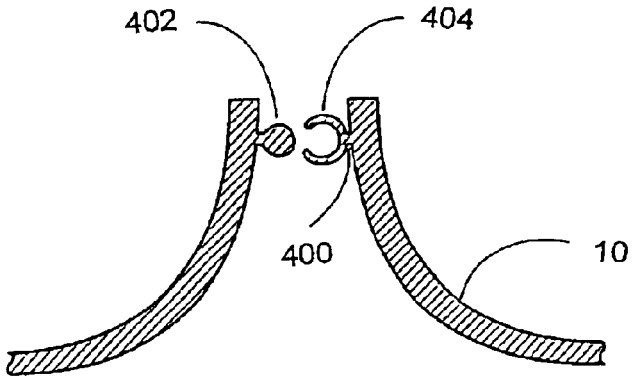
FIG. 4 illustrates a seal.
Figure 5:
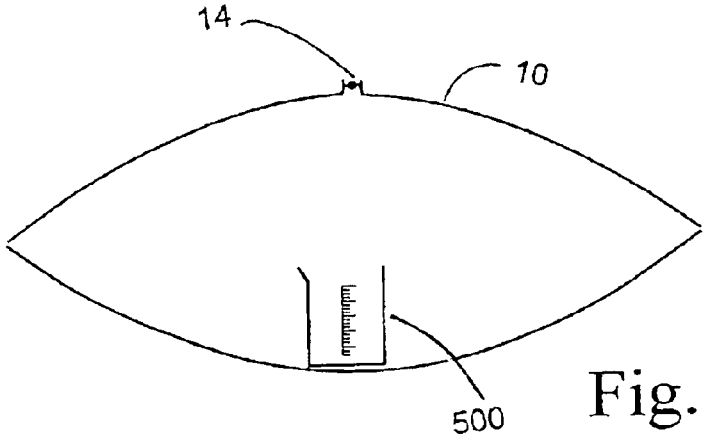
FIG. 5 illustrates a measuring vessel that is in a bag.
Figure 6:
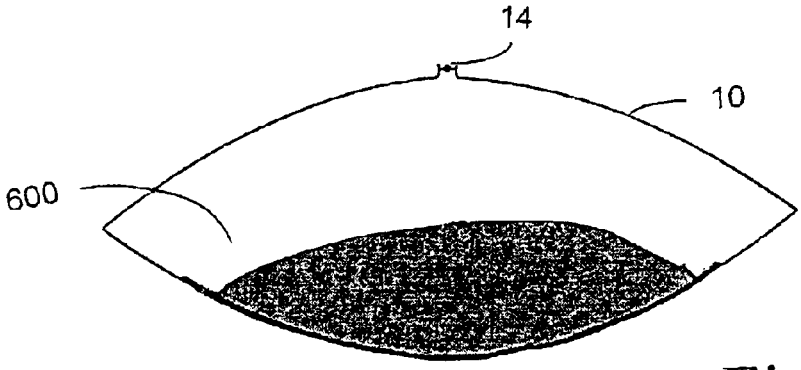
FIG. 6 illustrates flowable solids in a bag.

In use, of the bags in FIGS. 1, 2 and 3 the constituents of the mix that is to be prepared are placed in the bag and the appropriate volume of liquid is added to the mix. For example, if preparing mortar, sand and cement would be placed in the bag and water would be added. The seal 14 is then closed to retain the powder within the bag and mixing is carried out by alternately raising the two handles 12 to cause the contents of the bag to roll and tumble alternately in opposite directions. Because all the mixture is contained in the bag, mixing can be carried out with little or no mess and the tumbling action mixes the constituents almost as quickly and as thoroughly as a powered mixer.

The mix can be carried to the site where it is to be used by means of the same bag. If both handles 12 or 12' are held together, the bag 10 can be carried without the risk of spillage of the mix. Once the mix has been used, the bag can be re-used. If the mix is still wet, it can be washed out readily. If the mix is allowed to harden, on the other hand, because the material of the bag is flexible it can be peeled away from the hardened residue.

Even though the bag can readily be re-used, it is more convenient for it to be disposable and to this end it is possible to use the bag as the packaging for the constituents. Thus, when buying a bag of plaster, the powder would be packaged in a bag of the invention and the user would have only to open the bag and add water. The package may in this case additionally include a measuring vessel included in the bag, such as a plastics ball or a graduated bucket, to ensure that the correct quantity of water is added to the mix.

Though the invention has been described by reference to building material, it may be used in other applications. For example, when baking, one may need to mix together powder ingredients such as flour, sugar and cocoa powder and then to add liquids such as water, milk and egg yokes to form a mix.

Although a specific embodiment of the invention has been disclosed, it will be understood by those having skill in the art that changes can be made to this specific embodiment without departing from the spirit and scope of the invention. The scope of the invention is not to be restricted, therefore, to the specific embodiment, and it is intended that the appended claims cover any and all such applications, modifications, and embodiments within the scope of the present invention.

What is claimed is:

1. A bag for enabling a flowable solid to be mixed with a liquid, the bag comprising:

an elongated body with walls formed entirely of a flexible liquid-impermeable material; one or more handles attached to a first end and a second end of the elongated body, the one or more handles lying in a plane; and a resealable mouth for enabling the ingredients to be mixed to be introduced into the elongated body;

wherein the elongated body is formed to have a greater width in the plane at a center portion of the elongated body that tapers to a smaller width near the first end and the second end.

2. The bag of claim 1, wherein the elongated body comprises two sheets of plastics material welded to one another along a curved a path.

3. The bag of claim 2, wherein the resealable mouth includes a seal comprising:

a part cylindrical bead on a first side of the resealable mouth; and a part-cylindrical socket on a second side of the resealable mouth;

wherein the part-cylindrical socket is adapted to receive the part cylindrical bead.

4. The bag of claim 1, wherein the resealable mouth includes a seal comprising:

a part cylindrical bead on a first side of the resealable mouth; and a part-cylindrical socket on a second side of the resealable mouth;

wherein the part-cylindrical socket is adapted to receive the part cylindrical bead.

5. The bag of claim 1, wherein the elongated body forms a banana-shaped bag.

6. A mixing package comprising:

one or more flowable solids contained within an elongate flexible liquid-impermeable bag having a handle at each end for enabling the bag to be gripped manually, the handle at each end lying in a plane; and a resealable mouth for allowing a liquid to be added to the contents of the bag, characterized in that the bag is fashioned to have a greater width in the plane at its center that tapers to a smaller width near each end.

7. The mixing package of claim 6, further comprising:

a measuring vessel, included in the bag, for ensuring that the correct quantity of liquid is added to the mix.

8. The mixing package of claim 7, wherein the resealable mouth includes a seal comprising:

a part cylindrical bead on a first side of the resealable mouth; and a part-cylindrical socket on a second side of the resealable mouth;

wherein the part-cylindrical socket is adapted to receive the part cylindrical bead.

9. The mixing package of claim 6, wherein the resealable mouth includes a seal comprising:

a part cylindrical bead on a first side of the resealable mouth; and a part-cylindrical socket on a second side of the resealable mouth;

wherein the part-cylindrical socket is adapted to receive the part cylindrical bead.

10. The mixing package of claim 6, wherein the one or more flowable solids includes at least one of flour, sugar, coca powder.

11. The mixing package of claim 6, wherein the one or more flowable solids includes at least one of cement, plaster, aggregate.

12. The mixing package of claim 6, wherein the elongated body forms a banana-shaped bag.

* * * * *